US007179328B2

(12) United States Patent
Kim et al.

(10) Patent No.: US 7,179,328 B2
(45) Date of Patent: Feb. 20, 2007

(54) COLOR KEEPING SLIP-RESISTING SOLUTION

(76) Inventors: Tae Hoon Kim, 426 S. Norton Ave. #110, Los Angeles, CA (US) 90020; Whankoo Kang, Expo Apt.210-1503, Jeonmin-Dong, Yusung-Gu, Daejon (KR); Yongkyu Hwang, Eunhasu Apt. 603, Yokam-Dong, Kangnam-Ku, Seoul (KR)

( * ) Notice: Subject to any disclaimer, the term of this patent is extended or adjusted under 35 U.S.C. 154(b) by 0 days.

(21) Appl. No.: 11/005,425

(22) Filed: Dec. 7, 2004

(65) Prior Publication Data

US 2006/0117997 A1 Jun. 8, 2006

(51) Int. Cl.
*C09K 3/14* (2006.01)

(52) U.S. Cl. ..... 106/36; 106/287.3; 516/198; 516/203

(58) Field of Classification Search ..... 106/36, 106/287.3; 516/198, 203
See application file for complete search history.

(56) References Cited

U.S. PATENT DOCUMENTS 5,423,910 A * 6/1995 Schiller ..... 106/36
5,660,891 A * 8/1997 Kenyon et al. ..... 427/445
5,698,021 A * 12/1997 Dorsett ..... 106/36
5,728,660 A * 3/1998 Borah ..... 510/110
5,885,339 A * 3/1999 Dorsett ..... 106/36
6,423,674 B1 * 7/2002 Williams et al. ..... 510/214
6,767,586 B1 * 7/2004 Coven ..... 427/376.1
6,767,869 B2 * 7/2004 DiLullo et al. ..... 507/244

* cited by examiner

*Primary Examiner*—Anthony J. Green
(74) *Attorney, Agent, or Firm*—Eugene Oak

(57) ABSTRACT

An aqueous solution for treatment of colored concrete, glazed enamel or porcelain surfaces to increase the coefficient of friction of that surface, whether dry or wet, to about 0.8 without deteriorating the color of the surface comprises about 1.5 to 1.9 wt % of ammonium bifluoride, 1.5 to 3.0 wt % of tri-ethylamine and a wetting agent in water. The degree of change of the color of the surface, treated seven minutes with the solution of the current application, measured by a color meter shows only 0.56 while the result of a commercial solution to increase the frictional coefficient shows 2.22. This means that the color change by the solution of the current application is undetectable by human eyes. Meanwhile, the change by the commercial solution product is detectable.

1 Claim, No Drawings

COLOR KEEPING SLIP-RESISTING SOLUTION

FIELD OF THE INVENTION

The present invention relates to a solution for treatment of colorful glazed or porcelain surfaces to increase the coefficient of friction of that surface without deteriorating the color of the surface.

DESCRIPTION OF THE PRIOR ART

Most of the solutions used to clean and increase the friction coefficient of the surface of bath tub tiles, ceramics and cements eliminate organic materials and dirt from the surface of those materials. They contain strong acids and fluoro compounds to etch out the organic materials from the micro-pores of the surfaces. U.S. Pat. No. 5,423,910 to Schiller illustrates a solution for the treatment of cement, glazed or porcelain surfaces to increase the coefficient of friction of that surface, whether dry or wet, to greater than 0.6, preferably to about 0.8, wherein the solution comprises about 10% phosphoric acid, less than 40 grams of sodium bifluoride and a wetting agent in water. U.S. Pat. No. 5,660,891 to Kenyon, et al. illustrates a method for cleaning and slip-resistant treatment of a mineral floor surface including an untreated outer surface having an initial dynamic coefficient of friction is provided. The untreated outer surface has a residual film formed thereon which further includes bacterial contamination. The method comprises first forming a treatment solution comprising ammonium bifluoride, iodine, phosphoric acid, and water.

Then, the treatment solution is applied to the untreated outer surface of the mineral floor surface wherein (a) the amount of residual film formed thereon is substantially reduced (b) the initial dynamic coefficient of friction is increased by at least about 10%, and (c) bacterial contamination on said untreated outer surface is substantially eliminated for at least about 24 hours. U.S. Pat. No. 5,698,021 to Dorsett illustrates formulations and methods for preventing surfaces of natural or mineral materials or cementitious products from becoming slippery, especially when wet. The formulations comprise a non-fluorine-containing acid; a fluorine-containing compound, hydrogen sulfate or acetic acid; and a surfactant. U.S. Pat. No. 6,423,674 to Williams, et al. illustrates an aqueous solution for treating and maintaining floors, cleans the floor and restores an optimum coefficient of friction. The solution involves a restoring phase and a cleaning phase, in which the cleaning phase is performed using the same solution as in the restoring phase, but in a diluted form. The solution is applicable to cleaning solid hard floors such as those made of unglazed quarry tiles, glazed ceramic tiles and cement.

U.S. Pat. No. 6,767,586 to Coven illustrates one-step method of treating a surface to increase its coefficient of friction without pre-treating the surface or rinsing or removing a treating solution, utilizes an aqueous solution of ammonium bifluoride, and allows the solution to remain on the surface until the surface has dried. Preferred methods of application are applying the solution with a mop, by wiping the surface with a rag treated with the solution and by applying a mist of the solution onto the surface.

None of the prior arts introduce a compound to prevent deterioration of the color on the surface to be treated.

SUMMARY OF THE INVENTION

It is the purpose of current invention to provide a solution for the treatment of colorful glazed or porcelain surfaces to increase the coefficient of friction of that surface, whether dry or wet, to about 0.8 without deteriorating the color of the surface that comprises about 1.5 to 1.9 wt % of ammonium bi-fluoride, 1.5 to 3.0 wt % of tri-ethylamine and a wetting agent in water. The degree of change of the color of the surface, treated seven minutes with the solution of the current application, measured by a color meter (Nippon Denshokusha ZE-2000 model), shows only 0.56 while the result of a commercially selling solution that increases the frictional coefficient shows 2.22. This means that the color change done by the solution of the current application is undetectable by human eyes while the change by the commercial solution is detectable. By increasing the amount of tri-ethylamine added to the ammonium bifluoride solution up to 3 wt %, the frictional coefficient of the surface treated does not decrease significantly and stays around 0.81. The frictional coefficient was measured with Slip Resistance Tester-Model XL manufactured by William English Inc. However, as the concentration of tri-ethylamine increases to 4.5 wt %, the frictional coefficient dropped to 0.75. The concentration of ammonium bifluoride is fixed to 1.99 wt %. Using excess amount of ammonium bifluoride, over 4 wt %, deteriorates the color of the treated surface significantly. Degree of change of the color measured records 4.25 to 22 at 8 wt % ammonium bifluoride concentration and 15 minutes of treating.

DETAILED DESCRIPTION OF THE PREFERRED EMBODIMENT

1. Preparation of the Sample Solution 2 wt % of ammonium bifluoride and 3 wt % of triethylamine are dissolved in distilled deionized water and adjust pH to 5.5. Two groups of solutions are prepared. Group 1 is prepared as the ratio of distilled water 4: solution 1 as described in the Posgrip®'s manual. Group 2 is prepared with 3 wt % of different surfactants and 2 wt % of ammonium bifluoride in distilled and deionized water. Polyethylene glycol and polyethylene glycol methyl ether were used for compare the effect of surfactants 2. Porcelain Tile Samples Porcelain tile samples for measuring dynamic frictional coefficient are made by Chunkwawng industrial Co., LTD's BES tile (pink colored porcelain floor tile with a dimension of 300 mm width by 300 mm length by 8.0 mm thickness). Tile samples for measuring degree of color deterioration are red tiles manufactured by Dongsu industrial Co., LTD. Product name is CERAMICA LUNA (Purple colored ceramic floor tile with a dimension of 197 mm width by 197 mm length by 7.0 mm thickness.

3. Treatment of Samples

Wash the surface of tiles with distilled and deionized water and dry. Half side of the dried tile is covered with aluminum foil and sealed with Scotch® tape to prevent wetting of the sealed surface by sample solution. Spray the sample solution over the exposed surface of the tile and leave it in ambient temperature for 7 minutes and then 15 minutes. Wipe out the exposed surface of the tile with water and a wet towel. Remove the aluminum foil and Scotch® tape. Measure the dynamic frictional coefficient and color of the treated surface and compare with those of the sealed surface of the same tile. Dynamic frictional coefficient is measured by a slip resistance tester (Model XL, William English Inc., U.S.A) and degree of color deterioration is measured by a color meter (Model ZE-2000, Nippon Denshokusha).

Table 1. shows the effect of concentration of ammonium bifluoride and treating time on the frictional coefficient of the treated surface. The concentration of ammonium bifluoride was increased from 1.2 wt % to 4.0 wt %. Triethylamine was not added. Effect of treating time was measured at 7 minutes and 10 minutes.

TABLE 1

| | Ammonium bifluoride (wt %) | | | | | | | | | |
|---|---|---|---|---|---|---|---|---|---|---|
| | 1.2 | | 1.5 | | 1.8 | | 2.0 | | 4.0 | |
| Treating Times (min) | 7 | 10 | 7 | 10 | 7 | 10 | 7 | 10 | 7 | 10 |
| Frictional Coefficient | 0.748 | 0.783 | 0.783 | 0.803 | 0.820 | 0.830 | 0.830 | 0.853 | 0.826 | 0.843 |

As shown in Table 1, the frictional coefficient of the treated surface increased with the treating time. The frictional coefficient increases from 0.748 at 1.2 wt % of ammonium bifluoride concentration and 7 minutes to 0.853 at 2.0 wt % of ammonium bifluoride concentration and 10 minutes. However, as the concentration of ammonium bifluoride reaches 4 wt % the frictional coefficient decreases slightly. This means that ammonium bifluoride over 2 wt % is useless for increasing the frictional coefficient.

Table 2. shows the effect of the concentration of triethylamine on the frictional coefficient of the treated surface. The concentration of the ammonium bifluoride is fixed at 1.99 wt %.

TABLE 2*

| | Triethyl amine (wt %) | | | | | | | |
|---|---|---|---|---|---|---|---|---|
| | 1.5 | | 3.0 | | 4.5 | | Slip fighter** | Posigrip*** |
| Treating Times (min) | 7 | 10 | 7 | 10 | 7 | 10 | 10 | 10 |
| Frictional Coefficient | 0.813 | 0.835 | 0.813 | 0.833 | 0.753 | 0.805 | 0.833 | 0.830 |

*Ammonium bifluoride concentration is fixed at 1.99 wt %.
**Finalized formulation.
***Commercial product of other company.

As shown in Table 1 and Table 2, the effect of adding tri-ethylamine is negligible until the concentration reaches 3.0 wt %. However, as the concentration becomes 4.5 wt %, the frictional coefficient decreases drastically. The final concentration of tri-ethylamine is fixed as 3.0 wt %. Comparison with other commercial product shows equivalent or better frictional coefficient.

Table 3 shows the effect of the concentration of aluminum bifluoride on the degree of deterioration of the color of the solution treated surface. Tri-ethylamine was not added to the solution. Treating time is selected as 7 minutes and 15 minutes.

TABLE 3*

| | Aluminum Bifluoride (wt %) | | | | | | | |
|---|---|---|---|---|---|---|---|---|
| | 2.0 | | 4.0 | | 6.0 | | 8.0 | |
| Treating Times (min) | 7 | 15 | 7 | 15 | 7 | 15 | 7 | 15 |
| Degree of Color | 1.42 | 2.43 | 3.68 | 4.25 | 4.18 | 6.72 | 7.48 | 22.0 |

TABLE 3*-continued

| | Aluminum Bifluoride (wt %) | | | |
|---|---|---|---|---|
| | 2.0 | 4.0 | 6.0 | 8.0 |
| Deterioration (ΔE) | | | | |

As shown in Table 3, the degree of color deterioration increases with the concentration of aluminum bifluoride at 7 minutes of treating time. When the treating time is increased to 15 minutes, the degree of color deterioration increases exponentially. This means that if a user treats a surface of colored surface of tile with a solution having high concentration of ammonium bifluoride over 15 minutes by mistake, the color of the tile will be changed from the original color.

Table 4 shows the effect of tri-ethylamine added to the treating solutions containing different aluminum bifluoride concentration on the degree of color deterioration. The concentration of tri-ethylamine is fixed as 3 wt % and aluminum bifluoride concentration is changed from 2 wt % to 8 wt %.

TABLE 4

| | AB*:TEA** Concentration (wt %) | | | | | | | | |
|---|---|---|---|---|---|---|---|---|---|
| | 2:3 | | 4:3 | | 6:3 | | 8:3 | | Posigrip*** |
| Treating Times (min) | 7 | 15 | 7 | 15 | 7 | 15 | 7 | 15 | 7 |
| Degree of Color Deterioration (ΔE) | 0.56 | 1.07 | 1.02 | 2.18 | 2.38 | 2.71 | 2.98 | 5.0 | 2.22 |

*AB: Ammonium bifluoride.
**TEA: Triethylamine.
***Commercial product of other company.

As shown in Table 4, the degree of color deterioration increases as the concentration of ammonium bifluoride increases. By comparing Table 4 and Table 3, it is clear that addition of tri-ethylamine suppresses the deterioration of color. For 2 wt % ammonium bifluoride solution, the degree of color deterioration reduces to less than half as 3 wt % of tri-ethylamine is added. This trend worsens as the concentration of ammonium bifluoride is higher.

Table 5 shows the effect of treating times with the solution of current application and another commercial product.

TABLE 5

| | Products | | | | | | |
|---|---|---|---|---|---|---|---|
| | | Slip Fighter* | | | Posigrin** | | |
| Treating Times (min) | None | 5 | 7 | 10 | 5 | 7 | 10 |
| Frictional Coefficient | 0.36 | 0.81 | 0.89 | 0.92 | 0.77 | 0.83 | 0.87 |

*Product of current application.
**Commercial Product

As shown in Table 5, the aqueous solution of the current application shows increase of the frictional coefficient from 0.36 to over 0.81. That increase is slightly better than the commercial product.

Table 6 shows the effect of other surfactants compared with the triethylamine to the dynamic friction coefficient and degree of color change.

TABLE 6

| Aluminum Bifluoride (2 wt %) | Treating Time (min) | Degree of Color Change | Dynamic Frictional Coefficient |
|---|---|---|---|
| Tri Ethyl Amine (3 wt %) | 7 | 0.56 | 0.813 |
| Polyethylene Glycol (3 wt %) | 7 | 2.16 | 0.65 |
| Polyethylene Glycol Methyl Ether (3 wt %) | 7 | 1.93 | 0.71 |

As shown in Table 6, triethyl amine has the unexpected effect of protecting color while increasing dynamic frictional coefficient. Other surfactants actually disturb the aluminum bifluoride while etching the contaminated surface of tile but has no effect of protecting color. Only triethyl amine has desirable effect of color protecting and etching contaminated surfaces.

What is claimed is:

1. An aqueous solution, which comprises of a mixture triethylamine, ammonium bifluonde and a wetting agent in water wherein concentration of triethylamine is 3 wt %, ammonium bifluoride is 1.99 wt % and wetting agent is 0.1 wt %, for treating colored concrete, glazed enamel or porcelain surfaces to increase coefficient of friction of the surface from about 0.36 to about 0.81 without severely deteriorating original color by maintaining degree of color deterioration below 1.1.

* * * * *